US007377612B2

(12) United States Patent
Uji et al.

(10) Patent No.: US 7,377,612 B2
(45) Date of Patent: May 27, 2008

(54) INKJET RECORDING APPARATUS

(75) Inventors: Ayako Uji, Tokyo (JP); Noribumi Koitabashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 10/700,553

(22) Filed: Nov. 5, 2003

(65) Prior Publication Data

US 2004/0090484 A1 May 13, 2004

(30) Foreign Application Priority Data

Nov. 8, 2002 (JP) ..... 2002-325879

(51) Int. Cl.
*B41J 29/38* (2006.01)

(52) U.S. Cl. ..... 347/17
(58) Field of Classification Search ..... 347/6, 347/14, 17, 60, 40
See application file for complete search history.

(56) References Cited

U.S. PATENT DOCUMENTS

| | | | | |
|---|---|---|---|---|
| 4,791,435 | A * | 12/1988 | Smith et al. | 347/17 |
| 5,581,281 | A * | 12/1996 | Fuse | 347/14 |
| 5,736,995 | A * | 4/1998 | Bohorquez et al. | 347/14 |
| 5,880,751 | A | 3/1999 | Nishikori et al. | |
| 6,109,719 | A * | 8/2000 | Cornell | 347/14 |
| 6,322,189 | B1 * | 11/2001 | Anderson et al. | 347/17 |
| 6,457,794 | B1 | 10/2002 | Tajika et al. | |

* cited by examiner

*Primary Examiner*—Stephen Meier
*Assistant Examiner*—Geoffrey S. Mruk
(74) *Attorney, Agent, or Firm*—Fitzpatrick, Cella, Harper & Scinto

(57) ABSTRACT

The temperature of a recording head used for recording is adjusted by heating a recording head that is not used for recording and utilizing the effect of heat conduction. The adoption of such a configuration makes it possible to adjust the temperature of a recording head during recording by the use of a relatively simple temperature control circuit. Further, since temperature adjustment can be continuously and efficiently conducted, a good discharge condition can be achieved, and the speed of recording can be increased by reducing the number of recovery operations such as preliminary ejections.

7 Claims, 10 Drawing Sheets

INKJET RECORDING APPARATUS

This application claims priority from Japanese Patent Application No. 2002-325879 filed Nov. 8, 2002, which is incorporated hereinto by reference.

BACKGROUND OF THE INVENTION

1. Field of the Invention

The present invention relates to a method of controlling the temperature of a recording head of an inkjet recording apparatus.

2. Description of the Related Art

For example, inkjet recording apparatuses which eject ink from a plurality of ink ejection holes are known as recording apparatuses which perform recording using recording heads having a plurality of recording elements. In an inkjet recording apparatus, the temperature of ink before ejection is an important parameter for stable ejection of ink in a predetermined amount from each ejection hole.

In general, physical properties of ink such as viscosity and surface tension are apt to change depending on the temperature which also affects the state of ejection. In particular, the viscosity of ink increases in a low-temperature environment, which can result in unstable ejection and a reduction in recording quality. In order to avoid this, most inkjet recording apparatus employ a configuration in which a heater is provided inside or outside of a recording head to heat ink to a predetermined temperature prior to recording.

When ejection does not take place for a predetermined time or more, the viscosity of ink increases due to evaporation of moisture in the vicinity of ejection holes, and the discharge condition may be consequently degraded especially for several initial shots of ejection. Hereinafter, such a discharge condition of several initial shots is referred to as "initial discharge condition". A solution to this problem is to perform ejection a predetermined number of times until normal ejection is enabled in a place other than a recording position during recording or before the next recording is started. Such an ejecting operation is generally referred to as "preliminary ejection". However, a problem still arises in that recording speed is reduced by preliminary ejection because it interrupts recording when performed during recording.

In order to minimize preparatory ejecting operations, it is advantageous to adjust the temperature of a recording head in advance using a heater as described above. The reason is that an increase in ink viscosity can be prevented by adjusting the ink in the recording head to a temperature within a predetermined range even if there is some evaporation of moisture.

Several methods have already been proposed and put in use to eject ink from inkjet recording apparatus. Above all, a method is frequently used in recent years in which: an electrothermal transducer (ejection heater) is provided in each of a plurality of ink channels leading to respective ejection holes; an electrical pulse is applied to them to cause film boiling; and ink is ejected from the ejection holes by bubbling energy thus generated. In an inkjet recording apparatus having such a configuration, heaters for keeping the temperature of the recording heads (hereinafter referred to as "sub-heaters") are frequently provided separately from the ejection heaters used for ejection. The two types of heaters are provided on the same substrate that forms a part of the recording heads. In order to control the temperature of ink prior to recording, not only the sub-heaters but also the ejection heaters may be used in combination. In this case, the ink is warmed by the ejection heaters directly and by the sub-heaters indirectly before it is ejected.

When the ejection heaters are used as a heating source for the ink, such a short pulse that no bubbling is caused thereby is applied to the ejection heaters. The temperature of the recording heads is continually detected, and the application is continued until a predetermined temperature is reached and is stopped when the predetermined temperature is reached. The temperature of the recording heads is kept within the predetermined range through repetition of the process.

When the sub-heaters are used as a heating source for the ink, in general, the sub-heaters are continuously energized until the predetermined temperature is reached. Referring to the detection of the recording head temperature, the temperature of the ink may be detected either directly or indirectly. In either case, the energization of the sub-heaters is continued until the temperature of the recording heads thus detected reaches the predetermined temperature and stopped when it becomes equal to or higher than the predetermined temperature. The temperature of the recording heads is kept within the predetermined range through repetition of the process.

However, the temperature adjusting method utilizing ejection heaters and sub-heaters as described above still has the following problems to be solved.

For example, according to the temperature adjusting method utilizing ejection heaters, the temperature of ejection heaters can instantaneously increase to generate bubbles even when they are driven with such a short pulse that no ejection is caused thereby. Such bubbles accumulate inside the recording head and have a bad influence on subsequent ejections.

A short pulse for heating cannot be applied to the ejection heaters while a pulse for ejection is applied to them. While control for temperature adjustment may be conducted in short intervals between ejections there is concern about a reduction in the recording speed and complicatedness of the control in this case. An alternative is to perform temperature adjustment until immediately before recording and not to conduct control for temperature adjustment during recording. However, when there is a long non-recording period in a recording operation, the temperature of the recording heads can decrease below the value to be maintained.

When temperature adjustment is performed using sub-heaters, the power of the sub-heaters used can be a problem. When heaters of high power are used, control may not be conducted with stability because of great temperature ripples, although a target temperature can be reached quickly.

When heaters of low power are used, a target temperature can be maintained with reduced temperature ripples by turning the energization of the same on and off repeatedly. However, it takes a long time to reach the target temperature when a great temperature increase is needed, which can affect recording time.

A possible approach is to perform temperature adjustment before a recording start instruction is received and to perform ejection as soon as the recording start instruction is received in order to prevent any adverse effect on the time of recording since the point in time when the recording start instruction is received. However, there will be no change in the time spent before the temperature of the recording heads reaches the target temperature in practice. When there is a great difference between the target temperature and the ambient temperature, the viscosity of the ink in the recording heads increases as a result of an increase in the density of a dye in the ink because a great amount of moisture evaporates from the recording heads when they stand by, which can result in degradation of the initial discharge condition. Further, since the recording heads are kept at a relatively high temperature, the generation and growth of bubbles in the ink are promoted, and the ejection performance of the recording heads is therefore more vulnerable to adverse effects.

In order to avoid those problems, a method has already been proposed in which sub-heaters and ejection heaters are used in combination to perform temperature control. For example, the temperature is increased in a relatively short time using ejection heaters until it reaches a predetermined value that is lower than an actual target temperature and when the predetermined temperature is reached, the heating means is switched to sub-heaters to perform heating slowly up to the target temperature. In this case, however, a complicated circuit for simultaneously controlling the ejection heaters and the sub-heaters in the same recording head is required in occasions in which the recording head must be heated during recording such as when image data are sparsely distributed.

SUMMARY OF THE INVENTION

The invention was conceived to solve those problems, and it is an object of the invention to provide an inkjet recording apparatus in which adequate temperature adjustment can be performed on a recording head even during recording with a relatively simple circuitry.

In a first aspect of the present invention, there is provided an inkjet recording apparatus for performing recording by ejecting ink onto a recording medium using a plurality of recording heads which apply heat to the ink with heating means to generate bubbles in the ink and to eject the ink with the pressure of the bubbles, the apparatus comprising: recording mode setting means for setting a head that is to be used for recording and a head that is not to be used among the plurality of recording heads; and control means for heating the recording head that is set to be not used for recording by the recording mode setting means to adjust the temperature of the recording head to be used for recording utilizing heat conduction.

In a second aspect of the present invention there is provided an inkjet recording apparatus for performing recording by ejecting ink onto a recording medium using a plurality of recording heads which apply heat to the ink with heating means to generate bubbles in the ink and to eject the ink with the pressure of the bubbles, the apparatus comprising: discrimination means for discriminating between a recording head that is to be used and a recording head that is not to be used for the next recording to be performed; and control means for heating the recording head discriminated to be not used by the discrimination means before the recording head discriminated to be used for recording starts a recording operation to adjust the temperature of the recording head utilizing heat conduction.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments for carrying out the invention will now be described in detail with reference to the drawings.

Figure 1:
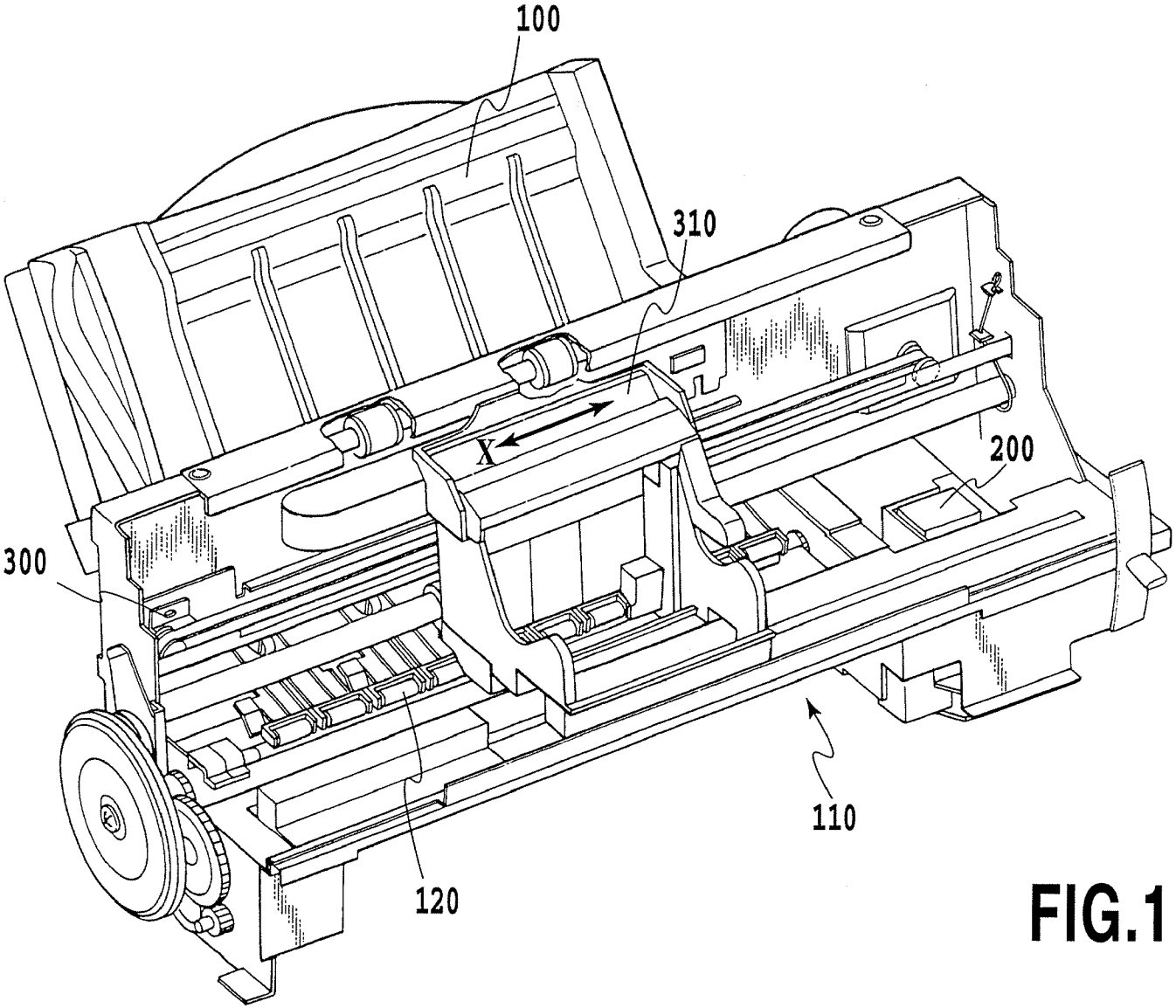
FIG. 1 is a perspective view showing a configuration of an inkjet recording apparatus to which the invention can be applied.

FIG. 1 is a perspective view showing a configuration of an inkjet recording apparatus to which the invention can be applied. A mechanism for a recording operation for carrying out the invention is comprised of an automatic feed section 100 for automatically feeding recording media into a main body of the apparatus, a transport section 110 for guiding the recording media delivered one by one from the automatic feed section 100 to a desired recording position and for guiding the recording media from the recording position to a paper discharge section 120, a recording section for performing desired recording on the recording media transported by the transport section 110, and a recovery section 200 for performing a recovery operation for the recording section.

The recording section is comprised of a carriage 310 movably supported by a carriage shaft 300 and a head cartridge H detachably mounted on the carriage 310.

Figure 2:
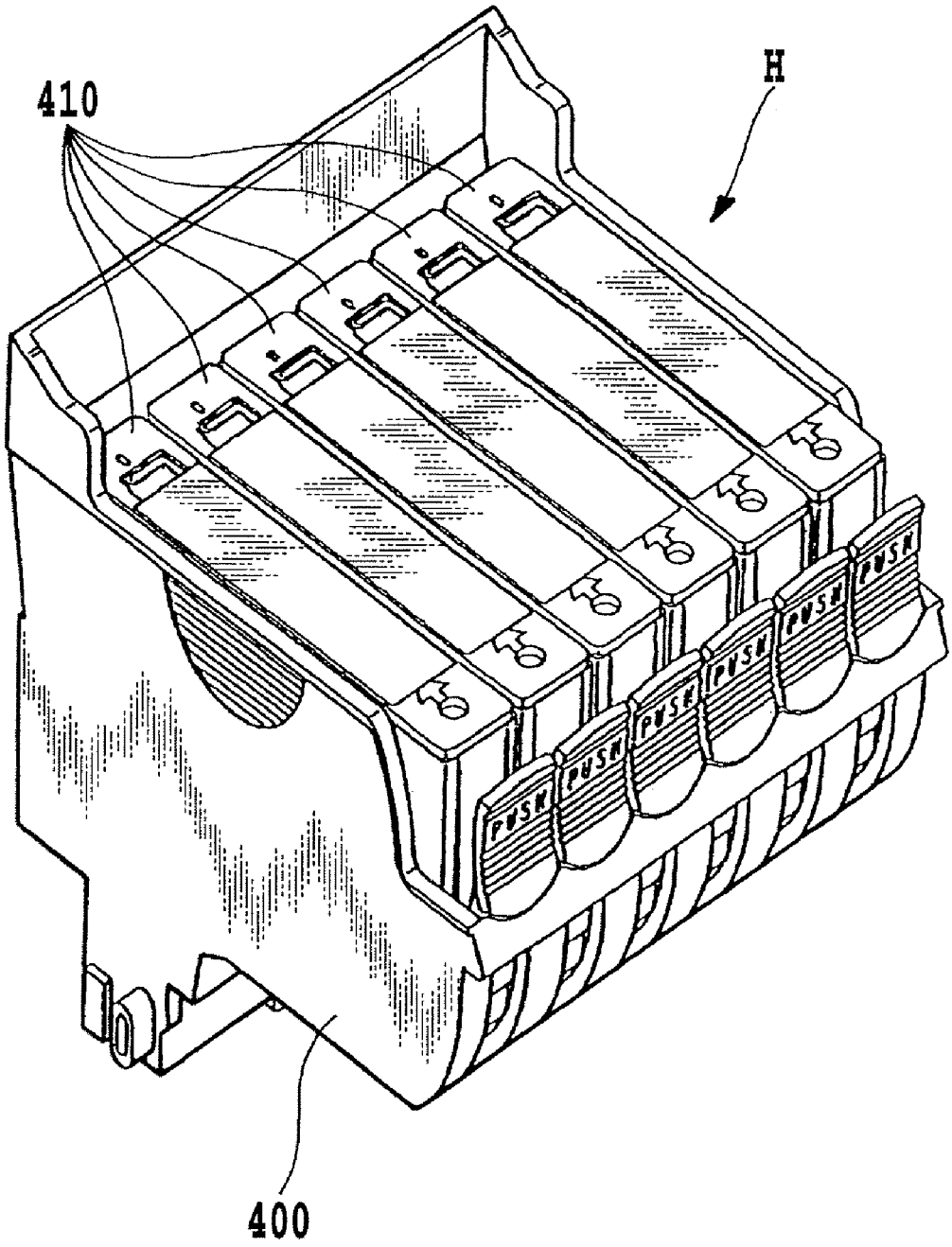
FIG. 2 illustrates an example of a configuration of a head cartridge which can be mounted on a carriage of the inkjet recording apparatus shown in FIG. 1.

FIG. 2 shows an example of a configuration of the head cartridge H. The head cartridge H has a head unit 400 that is configured integrally with a plurality of recording heads, and ink tanks 410 in which ink is stored to supply ink to each of the recording heads of the head unit 400. For example, ink tanks 410 for six colors, i.e., black (Bk), cyan (C), magenta (M), yellow (Y), light cyan (LC), and light magenta (LM), are prepared independently of each other, and each of them can be attached to and detached from the head unit 400.

Figure 3:
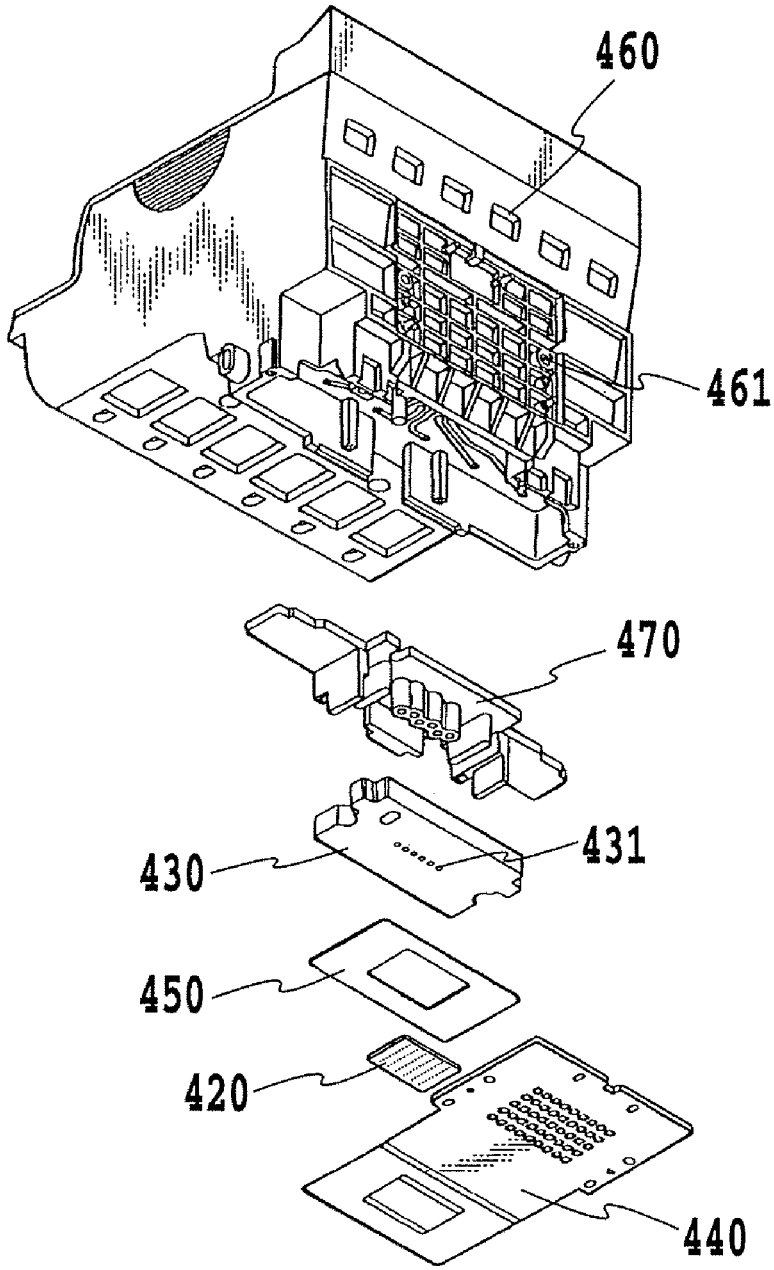
FIG. 3 is an exploded perspective view of a recording head unit for illustrating a structure of the same.

FIG. 3 is an exploded perspective view of the head unit 400 for explaining a structure of the same. In the figure the head unit 400 is comprised of a recording element substrate 420, a first plate 430, a second plate 450, an electrical wiring substrate 440, a tank holder 460, and a channel forming member 470.

The recording element substrate 420 is a silicon substrate, and a plurality of recording elements (which are also called nozzles) for ejecting ink and a plurality of ink channels associated with the recording elements, respectively, are formed on one side of the substrate, the elements and channels being integrally formed using a photolithographic technique. The recording element substrates 420 are provided to serve six colors, and securely bonded to the first plate 430 adjacently each other. In this specification, such a configuration is regarded as an integral configuration of a plurality of recording heads.

The first plate 430 is formed of aluminum oxide ($Al_2O_3$) that has high thermal conductivity, and it is provided with ink supply holes 431 for supplying ink in the six colors to the recording element substrate 420 in the form of slits. Therefore, heat generated by the recording head of a certain color is transferred to some degree to recording heads of other colors through the first plate 430. The second plate 450 having an opening is securely bonded to the first plate 430. The second plate 450 holds the electrical wiring substrate 440 such that the electrical wiring substrate 440 for applying electrical signals for ink ejection is electrically connected to the recording element substrate 420.

The channel forming member 470 is ultrasonically welded to the tank holder 460 which detachably holds the ink tank 410 thereby forming an ink channel 461 that connects the ink tank 410 to the first plate 430.

Figure 4:
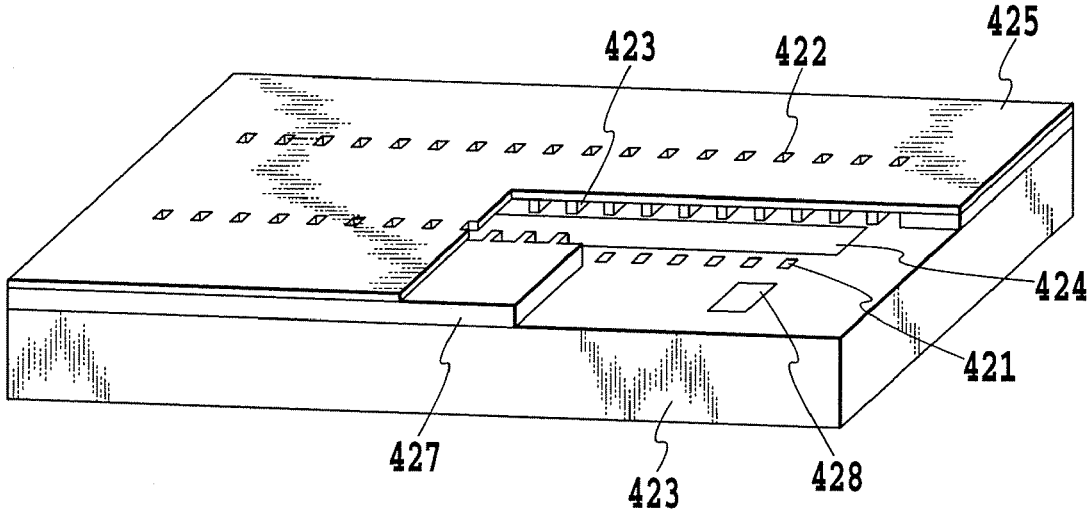
FIG. 4 is a partially cutaway perspective view of the recording element substrate shown in FIG. 3 showing a structure of the same in the vicinity of ejection holes for one color.

FIG. 4 is a partially cutaway perspective view of one of the recording heads of the recording element substrate 420 shown in FIG. 3, showing a structure in the vicinity of ejection holes thereof. In FIG. 4, reference numeral 421 represents ejection heaters for heating ink to eject the same. A sub-heater (not shown) for the recording head is also provided on the same substrate. Reference numeral 422 represents ink ejection holes; reference numeral 423 represents the element substrate; reference numeral 424 represents an ink supply hole for supplying ink from the ink tank 410; reference numeral 425 represents an ejection hole plate inward of which the ink ejection holes 422 are formed; reference numeral 426 represents channel walls that define ink channels connected to the ink ejection holes 422, respectively; reference numeral 427 represents a resin coating layer; and reference numeral 428 represents a temperature sensor. The temperature sensor 428 is for detecting the temperature of the neighborhood of the ejection holes of the recording head. The temperature sensor 428 may be provided in each of the six recording heads, and it may alternatively be provided on the element substrate of only one of the recording heads. Since the first plate 430 is formed with the ink supply holes 431 to serve six colors as described with reference to FIG. 3, the temperature of the recording element substrate 420 as a whole can be substantially reliably detected even if there is only one temperature sensor.

The head unit used in the present embodiment for carrying out the invention is provided with recording heads for six colors, comprising 256 recording elements per color A driving frequency of each recording element is 22 kHz which provides a recording resolution of 1200 dpi on a recording medium.

Figure 5:
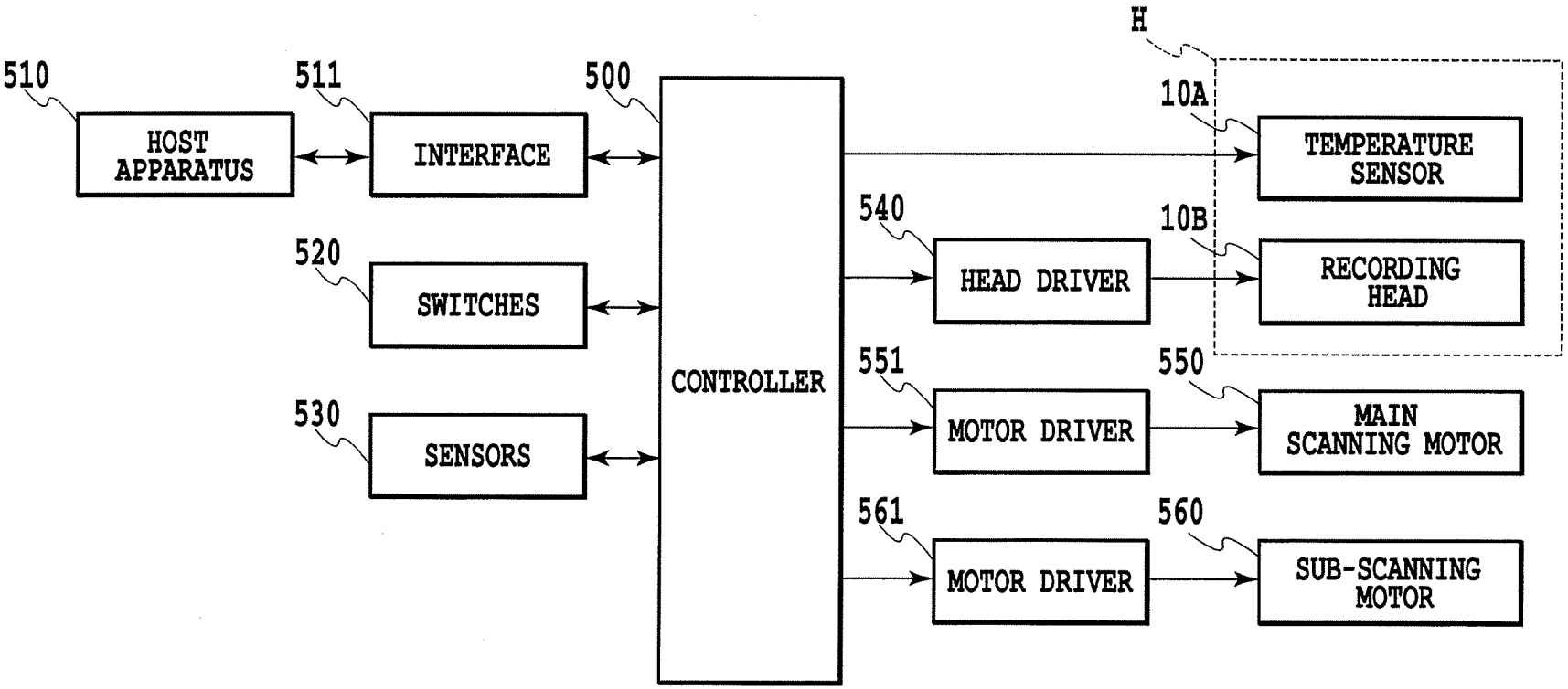
FIG. 5 is a block diagram showing an example of a configuration of a control system in the inkjet recording apparatus to which the invention can be applied.

FIG. 5 is a block diagram showing an example of a configuration of a control system of the inkjet recording apparatus. Reference numeral 500 represents a controller that is a main control section, and reference numeral 510 represents a host apparatus that is an image data supply source. Image data, commands, and status signals are transmitted and received between the host apparatus 510 and the controller 500 through an interface 511. Reference numeral 520 represents a group of switches for accepting commands from a user, and reference numeral 530 represents a group of sensors for detecting states of the recording apparatus.

Reference numeral 540 represents a head driver for driving the ejection heaters. Reference numerals 10A and 10B represent temperature sensors provided on the recording element substrates of the recording heads, and recording heads, respectively, a plurality of the sensors and heads being loaded on the head unit H. A temperature value detected by a temperature sensor 10A is input to the controller 500. Reference numeral 550 represents a main scanning motor for moving the carriage 310 in a main scanning direction, and reference numeral 551 represents a motor driver for driving the main scanning motor 550. Reference numeral 560 represents a sub-scanning motor for transporting recording media, and reference numeral 561 represents a motor driver for driving the sub-scanning motor 560.

The invention can be carried out by using an inkjet recording apparatus as described above. Several embodiments of the invention will now be described.

First Embodiment

The present embodiment is configured to allow setting of a recording mode in which all of the recording heads for six colors in the head unit shown in FIG. 2 are used and a recording mode in which recording is performed using only the recording heads for four colors, i.e., Bk, C, M, and Y among the six colors. The recording modes are set by the controller 500. The following description addresses recording using the recording heads for four colors.

Figure 6:
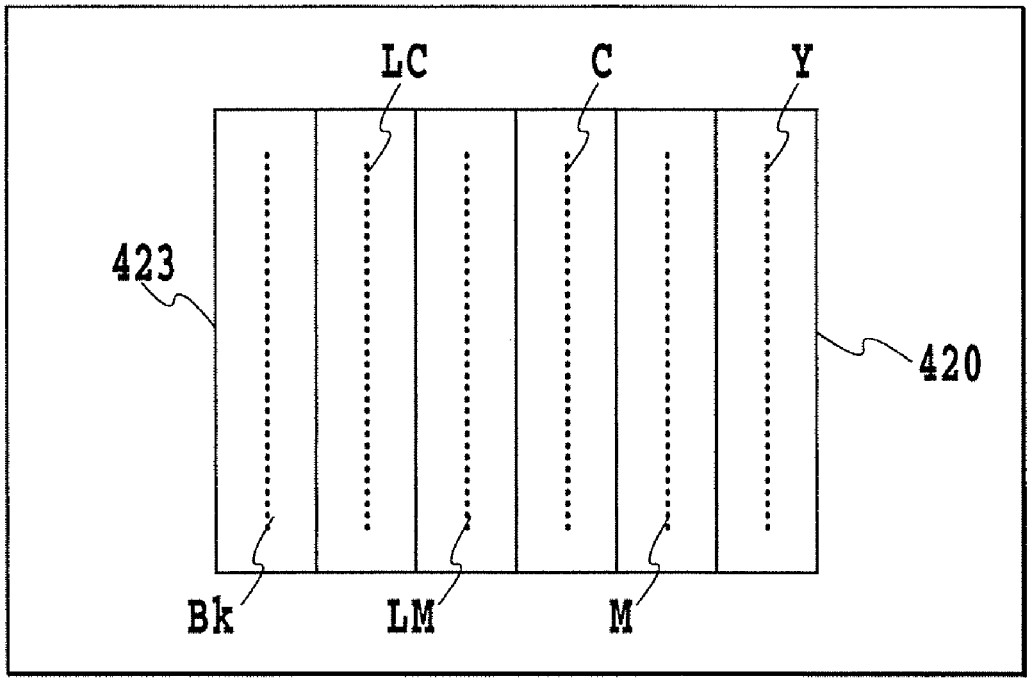
FIG. 6 is a plan view of the head unit shown in FIG. 2 taken on the side thereof where ejection holes are located.

FIG. 6 is a plan view of the head unit shown in FIG. 2 taken on the side thereof where the ejection holes are located. As apparent from the figure, the recording heads of the respective colors, i.e., black, light cyan, light magenta, cyan, magenta, and yellow, are arranged on the same plate in the above order of the colors starting with the black recording head at the left end.

In the present embodiment, ink used for recording is a liquid having properties that result in a better initial discharge condition in response to a temperature increase. For example, ink having the following composition may be used as an embodiment of the ink. The amount of each component shown below is represented by a density in terms of percent by weight.

dye: 3 to 5% diethylene glycol: 30%

Acetylenol EH (manufactured by Kawaken Fine Chemicals Co., Ltd.): 1.0%

The rest of the composition: water

In the present embodiment, the controller 500 starts adjusting the temperature of the recording heads when a recording start instruction is input and, when a predetermined target temperature is reached, it causes ejection of ink to start a recording operation. A first target temperature is 35° C. and a second target temperature is 40° C.

Figure 7:
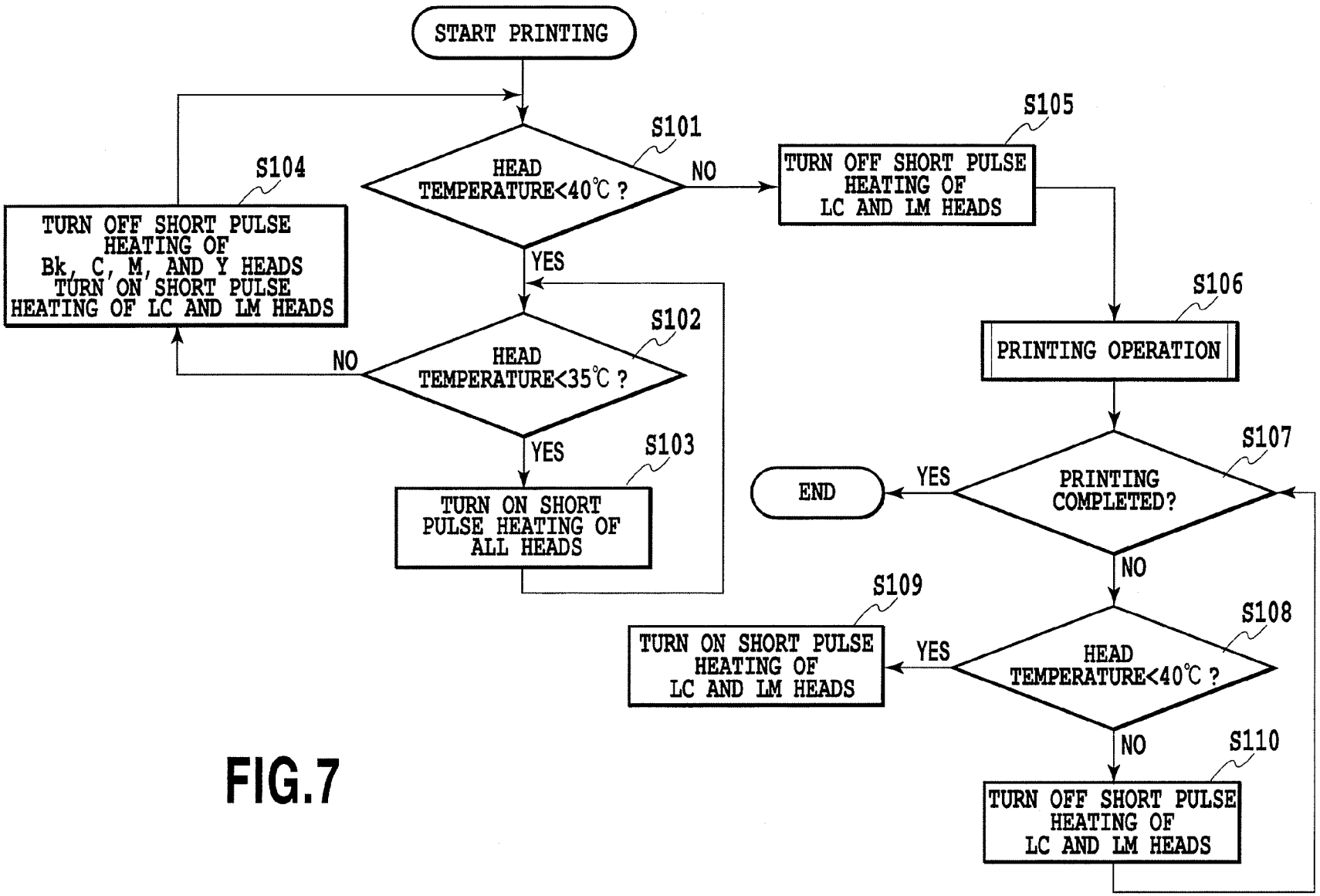
FIG. 7 is a flow chart for explaining processes performed by a controller in a first embodiment for temperature control according to the invention.

FIG. 7 is a flow chart for explaining processes performed by the controller 500 of the present embodiment. When a recording start instruction is input, the controller 500 detects the temperature of the recording heads (steps S101 and S102). In the present embodiment, the temperatures of the recording heads arranged on the same plate may be regarded as substantially constant. Therefore, an average of output values from the plurality of temperature sensors 10A is treated as the temperature of the plate or the temperature of each recording head 10B. When the recording head temperature thus obtained is lower than 35° C., the process proceeds to step S103 at which such a short pulse that the ejection heaters will not cause ejection is applied to all of the six recording heads to perform heating (hereinafter, such a method of heating is referred to as "short pulse heating"). Thus, the temperature of the recording heads is quickly increased.

When it is judged at step S102 that the temperature of the recording heads is 35° C. or higher, the process proceeds to step S104 at which the short pulse heating is stopped for four recording heads (BK, C, M, and Y) to be used for the next recording operation, and the short pulse heating is continued for the recording heads for LC and LM that are not used for the next recording operation. The short pulse heating is stopped for the recording heads used according to the recording mode setting for the purpose of simplifying electrical control or for a need for switching control of driving during the period between the point in time at which the first target temperature is reached and the commencement of a recording operation. Since the recording heads are located on the same plate, heat applied to the recording heads LC and LM is transferred to the other four recording heads because of heat conduction to increase the temperature of the entire plate further.

When it is judged at step S101 that the recording head temperature is 40° C. or higher, the process proceeds to step S105 at which the short pulse heating applied to the recording heads LC and LM is stopped.

At the subsequent step S106, a recording operation is started according to image data. When the recording operation is started, processes at step S107 and steps subsequent thereto are performed at predetermined time intervals. First, it is judged at step S107 whether recording has been completed or not. When it is judged that recording has not been completed yet, the process proceeds to step S108 at which the temperature of the recording heads is detected. When the detected value is lower than 40° C., the process proceeds to step S109 at which short pulse heating is performed only for the recording heads for LC and LM. When the value detected at step S108 is 40° C. or higher, the process proceeds to step S110 at which the short pulse heating of the recording heads for LC and LM is stopped.

According to the above-described method, since the temperature of the recording heads is adjusted only through short pulse heating, a target temperature can be reached in a short time. Further, the control circuit is simplified. Further, recording is not interrupted because temperature adjustment can be carried out using only the recording heads that are not used for recording, which improves the speed of recording. For example, when an ink is used which can maintain the favorable discharge condition without ejecting takes about 10 seconds at a temperature of 25° C. and about 40 seconds at 40° C., the number of recovery operations such as preliminary ejection is reduced according to the present embodiment to allow the speed of recording to be improved.

Second Embodiment

A second embodiment of the invention will now be described. The present embodiment is similar to the first embodiment in that the combination of used recording heads and unused recording heads depends on recording modes. Further, sub-heaters are used or not used depending on the recording modes in the present embodiment. A description will now be made on a recording mode in which recording is performed using the recording heads of four colors, i.e., Bk, C, M, and Y among the recording heads shown in FIG. 6.

Figure 8:
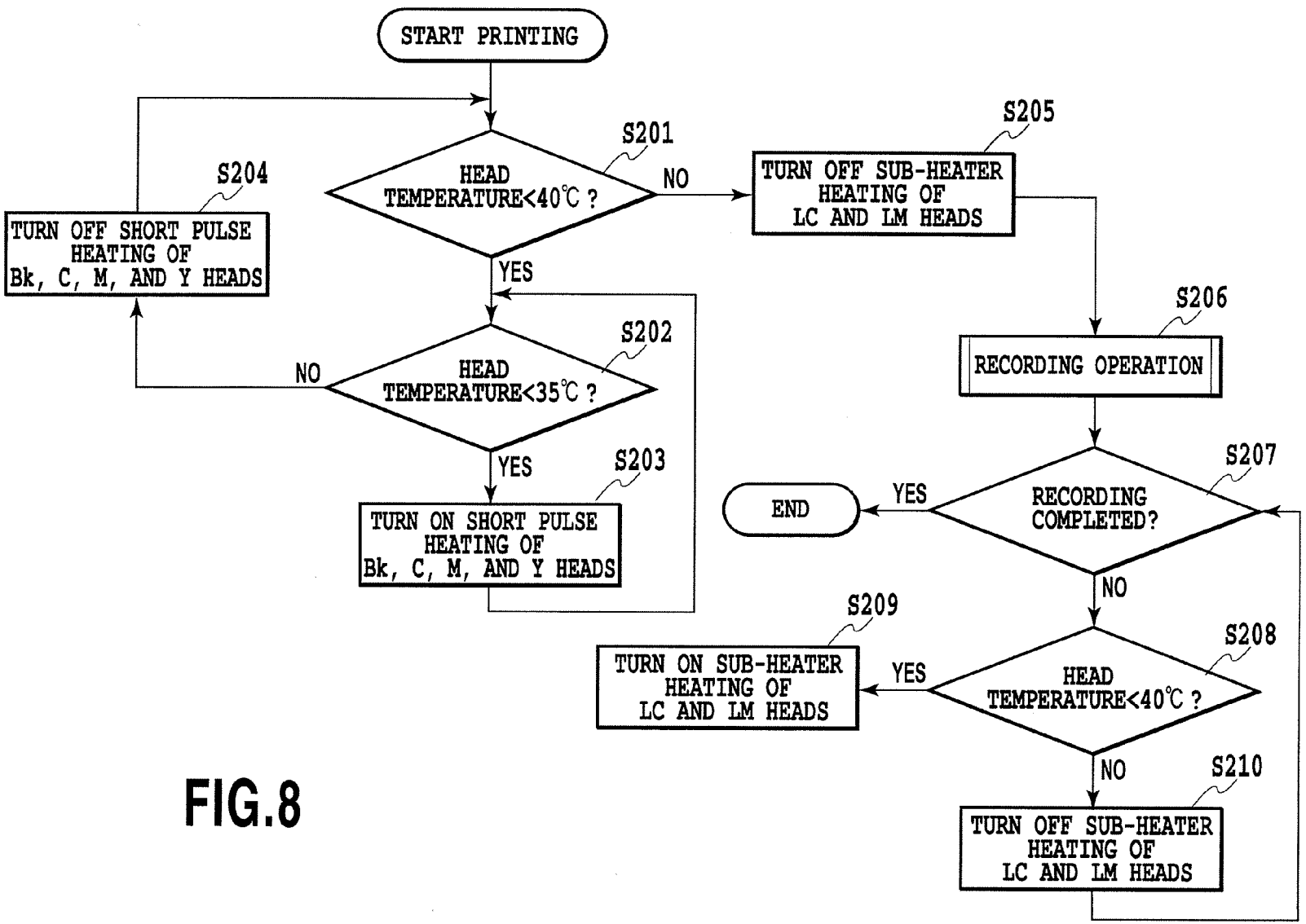
FIG. 8 is a flow chart for explaining processes performed by the controller 500 in a second embodiment of the invention.

FIG. 8 is a flow chart for explaining processes performed by a controller 500 in the present embodiment. The controller 500 in the present embodiment also starts adjusting the temperature of the recording heads when a recording start instruction is input and causes ink ejection to start a recording operation when a predetermined target temperature is reached. A first target temperature is 35° C. and a second target temperature is 40° C.

When the recording start instruction is input, the controller 500 detects the temperature of the recording heads (steps S201 and S202). The method of obtaining the recording head temperature is the same as that in the first embodiment. When the recording head temperature is lower than 35° C., the process proceeds to step S203 at which short pulse heating is performed on the four recording heads for Bk, C, M, and Y. At the same time, heating is started on two heads LC and LM that are not involved in recording, using sub-heaters.

When it is judged at step S202 that the temperature of the recording head is 35° C. or higher the process proceeds to step S204 at which the short pulse heating of the four recording heads Bk, C, M, and Y is stopped. At this time, heating with the sub-heaters is continued for the recording heads LC and LM that are not used for recording. Since the recording heads are all located on the same plate just as in the first embodiment, the heat of the recording heads for LC and LM is transferred to the other four recording heads because of heat conduction, which increases the temperature of the recording heads as a whole.

When it is judged at step S201 that the temperature of the recording heads is 40° C. or higher, the process proceeds to step S205 at which the heating with the sub-heaters for the recording heads for LC and LM is stopped.

At the subsequent step S206, a recording operation is started according to image data. When the recording operation is started, processes at step S207 and steps subsequent thereto are performed at predetermined time intervals. First, it is judged at step S207 whether recording has been completed or not. When it is judged that recording has not been completed yet, the process proceeds to step S208 at which the temperature of the recording heads is detected. When the detected value is lower than 40° C., the process proceeds to step S209 at which heating is performed using the sub-heaters only for the recording heads LC and LM. When the value detected at step S208 is 40° C. or higher, the process proceeds to step S210 at which the heating with the sub-heaters for the recording heads LC and LM is stopped.

The method utilizing short pulse heating as described in the first embodiment can result in the generation of bubbles in ink because it involves an abrupt increase in the head temperature, although the method allows the temperature of the recording heads to reach a target in a short time. The concern in the first embodiment can be eliminated to allow more stable temperature adjustment by the method according to the present embodiment in which the sub-heaters are used to heat all the recording heads until immediately before the beginning of recording and to heat the recording heads LC and LM during recording.

As described above, the present embodiment makes it possible to adjust the temperature of recording heads efficiently in a stable condition by heating heads that are not used for recording using sub-heaters in combination with short pulse heating performed using ejection heaters.

Third Embodiment

A third embodiment of the invention will now be described. In the present embodiment, the combination of used recording heads and unused recording heads depends on recording modes just as in the above-described embodiments. Further, sub-heaters are used or not used depending on the recording modes just as in the second embodiment. A description will now be made on a recording mode in which recording is performed using the recording heads of four colors, i.e., Bk, C, M, and Y, in the recording head shown in FIG. 6. In the present embodiment, control for temperature adjustment is performed at a predetermined time interval between the end of each recording operation and the beginning of the next recording operation when recording is successively performed on a plurality of sheets, and temperature control is performed for the recording heads LC and LM that are not used for recording.

Figure 9:
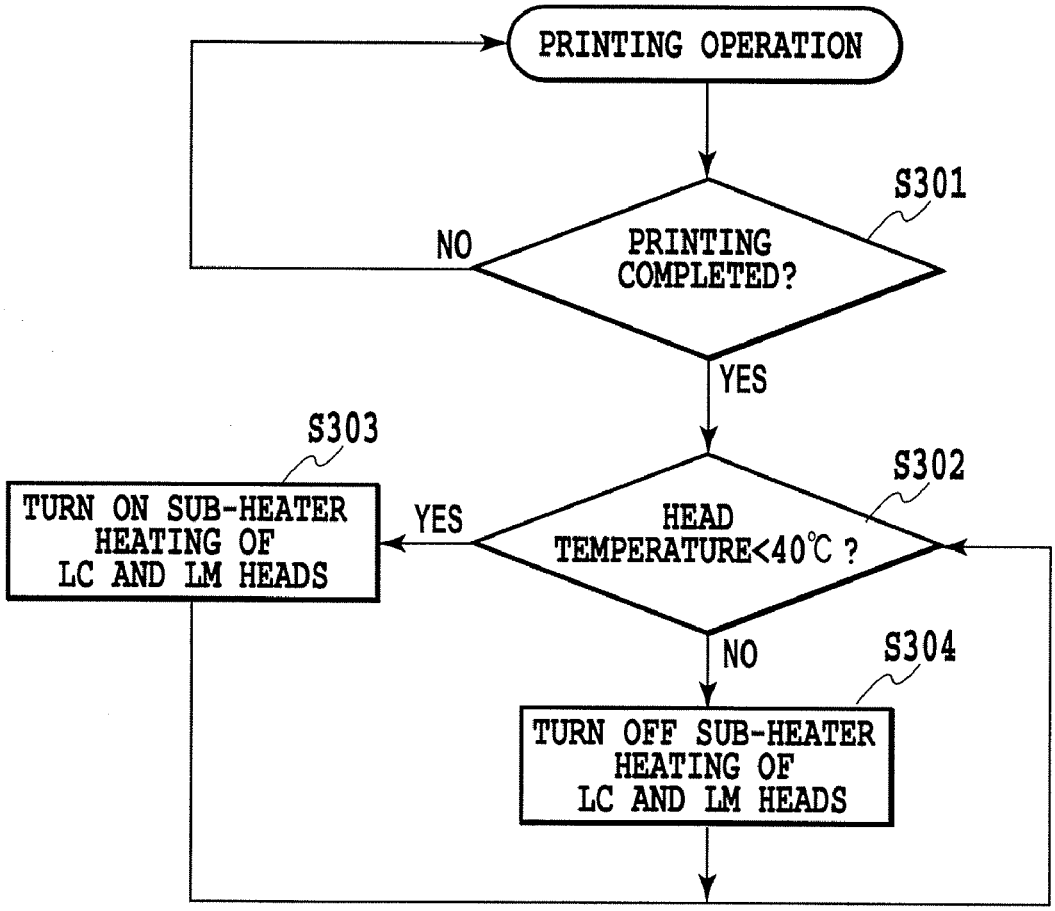
FIG. 9 is a flow chart for explaining processes performed by the controller 500 in a third embodiment of the invention.

FIG. 9 is a flow chart for explaining processes performed by a controller 500 in the present embodiment. When recording is completed for one page and it is judged at step S301 that recording has been completed, the process proceeds to step S302.

At step S302, the temperature of the recording heads is detected. When the detected head temperature is lower than 40° C., the process proceeds to step S303 at which heating is started for only the heads LC and LM using the sub-heaters When it is judged at step S302 that the head temperature is 40° C. or higher, the process proceeds to step S304 at which the heating of the heads LC and LM using the sub-heaters is stopped. After a predetermined time passes, step S302 is entered again to repeat the above-described process.

In the present embodiment, for example, when an ink is used which can maintain the favorable discharge condition without ejecting for about one minute at 40° C., a recording operation can be performed without any recovery operation such as preliminary ejection if it is started within one minute after the previous recording. When the succeeding recording operation is not started within one minute, a recovery operation may be performed before the succeeding recording operation is started.

As described above, the present embodiment makes it possible to reduce the number of recovery operations at the beginning of recording to improve the speed of recording by the use of an ink whose premium discharge condition becomes better as its temperature increases.

Others

It should not be construed that the invention is advantageous only for recording utilizing recording heads for four colors of a head unit comprising recording heads for six colors. The invention may be applied to any case wherein a head unit integrally configured of a plurality of recording heads is used and wherein recording is performed using some of the recording heads. For example, the invention may be used in a monochromatic recording mode in which a head unit comprising heads for four colors, i.e., Bk, C, M, and Y, is used and in which recording is performed using only the Bk head. At this time, temperature control is preferably performed using recording heads adjacent to the Bk head in order to improve the efficiency of heat conduction. Obviously, all of the remaining recording heads for C, M, and Y may be used.

Figure 10:
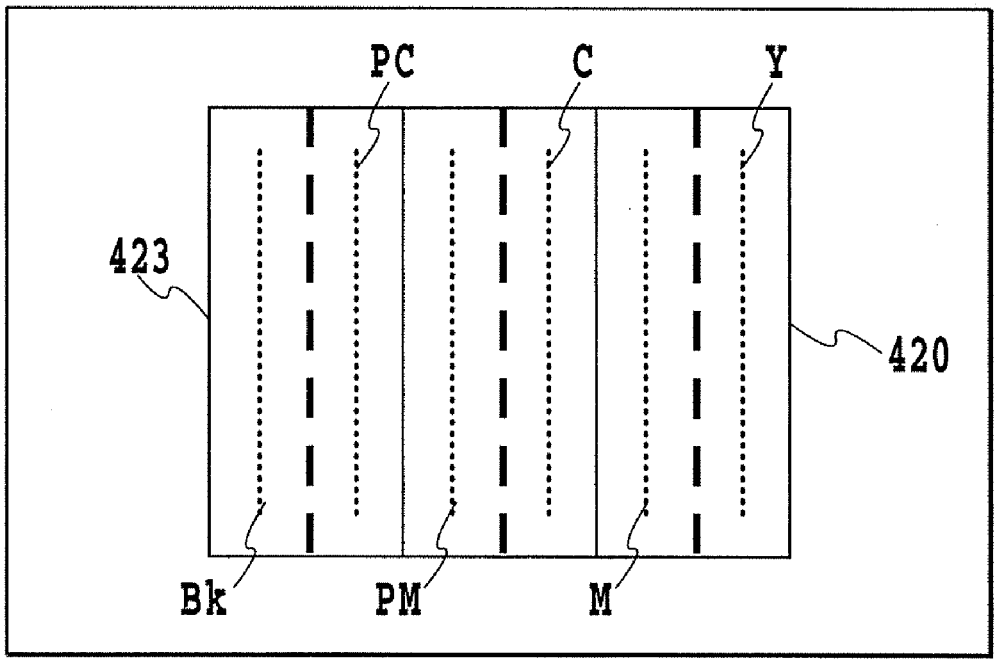
FIG. 10 is a plan view of a head unit in the third embodiment of the invention taken on the side thereof where ejection holes are located.

Referring to the recording heads, recording heads for two colors may be provided on a single recording element substrate as shown in FIG. 10. The advantages of the invention can be achieved even in such a configuration as long as a plurality of recording element substrates are arranged adjacent to each other on the same plate 420.

As described above, according to the invention, the temperature of recording heads used for recording is adjusted by heating recording heads that are not used for recording and by utilizing the effect of heat conduction. The adoption of such a configuration makes it possible to adjust the temperature of recording heads during recording by the use of a relatively simple temperature control circuit. Further, since temperature adjustment can be continuously and efficiently conducted, a good initial discharge condition can be achieved, and the speed of recording can be increased by reducing the number of recovery operations such as preliminary ejection.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An inkjet recording apparatus for performing recording by ejecting ink onto a recording medium using a plurality of heads, the apparatus comprising:

said heads, each ejecting a different color ink and each having a plurality of heating means to eject the same color ink;

a common support member on which said plurality of heads are arranged, said common support member conducting heat among said heads;

obtaining means for obtaining temperature of a printing head unit including said common support member and said plurality of heads;

a recording mode setting circuit for setting a head that is to be used for recording in a recording operation based on image data and a head that is not to be used for recording all the way through the recording operation based on the image data, from among said plurality of heads; and control means for controlling, when the obtained temperature of the printing head unit is lower than a first temperature, heating, not causing ejection, of all of the heads, controlling, when the obtained temperature of the printing head unit is higher than the first temperature and lower than a second temperature, heating, not causing ejection, of the heads set by said recording mode setting circuit to be not used for recording and stopping of heating, not causing ejection, of the heads set by said recording mode setting circuit to be used for recording, and controlling, when the obtained temperature of the printing head unit is higher than the second temperature, stopping of heating, not causing ejection, of all of the heads.

2. An inkjet recording apparatus according to claim 1, wherein, when the obtained temperature of the printing head unit is lower than the second temperature, said control means causes the heating means for the head that is not to be used for recording to generate heat such that the ink is not ejected from the head.

3. An inkjet recording apparatus according to claim 1, wherein, when the obtained temperature of the printing head unit is lower than the second temperature and higher than the first temperature, said control means causes heating of the head that is not to be used for recording while the head to be used for recording performs recording.

4. An ink jet recording apparatus according to claim 1, wherein said control means effects control of the heating before the head that is set by said recording mode setting circuit to be used for recording is started to be used for recording.

5. An ink jet recording apparatus according to claim 1, wherein each of said plurality of heads has a temperature sensor and said obtaining means obtains an average of outputs from said temperature sensors as the temperature of said printing head unit.

6. An inkjet recording apparatus for performing recording by ejecting ink onto a recording medium using a plurality of heads, the apparatus comprising:

said heads, each ejecting a different color ink and each having a plurality of heating means to eject the same color ink;

a common support member on which said plurality of heads are arranged, said common support member conducting heat among said heads;

obtaining means for obtaining temperature of a printing head unit including said common support member and said plurality of heads;

discrimination means for discriminating between a head that is to be used in a next recording operation based on image data and a head that is not to be used all the way through the next recording operation to be performed based on the image data; and control means for controlling, when the obtained temperature of the printing head unit is lower than a first temperature, heating, not causing ejection, of all of the heads, controlling, when the obtained temperature of the printing head unit is higher than the first temperature and lower than a second temperature, heating, not causing ejection, of the heads discriminated by said discrimination means to be not used for recording and stopping of heating, not causing ejection, of the heads discriminated by said discrimination means to be used for recording in the next recording operation, and controlling, when the obtained temperature of the printing head unit is higher than the second temperature, stopping of heating, not causing ejection, of all of the heads.

7. An inkjet recording apparatus according to claim 6, wherein a heater for heating provided independently of the heating means is controlled by said control means.

* * * * *